US007044323B2

(12) United States Patent
Yang et al.

(10) Patent No.: US 7,044,323 B2
(45) Date of Patent: May 16, 2006

(54) DETACHABLE FOOT PEDAL FOR TRASH CAN

(75) Inventors: Frank Yang, Palos Verdes Peninsula, CA (US); Joseph Sandor, Santa Ana Heights, CA (US)

(73) Assignee: Simplehuman LLC, Los Angeles, CA (US)

( * ) Notice: Subject to any disclaimer, the term of this patent is extended or adjusted under 35 U.S.C. 154(b) by 0 days.

(21) Appl. No.: 10/746,988

(22) Filed: Dec. 23, 2003

(65) Prior Publication Data

US 2005/0133506 A1 Jun. 23, 2005

(51) Int. Cl.
*B65D 43/26* (2006.01)

(52) U.S. Cl. ..... 220/263; 220/908

(58) Field of Classification Search ..... 220/263, 220/262, 264, 908, 908.1, 908.2, 908.3; 248/94, 248/95

See application file for complete search history.

(56) References Cited

U.S. PATENT DOCUMENTS 5,269,087 A * 12/1993 Johnston ..... 43/4
5,474,201 A * 12/1995 Liu ..... 220/23.87
5,758,888 A * 6/1998 Burgan et al. ..... 280/47.34
6,010,024 A * 1/2000 Wang ..... 220/23.87
6,102,343 A * 8/2000 Grimesey et al. ..... 248/95

* cited by examiner

*Primary Examiner*—Lien M. Ngo
(74) *Attorney, Agent, or Firm*—Raymond Sun

(57) ABSTRACT

A trash can assembly has a shell having a bottom end, a base secured to the bottom end and a foot pedal assembly coupled to the base. The foot pedal assembly has a pedal bar pivotably secured to the base, and a foot pedal. The foot pedal can be separated from the pedal bar before placing the trash can assembly inside a containing box.

15 Claims, 9 Drawing Sheets

DETACHABLE FOOT PEDAL FOR TRASH CAN

BACKGROUND OF THE INVENTION

1. Field of the Invention

The present invention relates to a trash can assembly, and in particular, to a foot pedal for a trash can assembly that can be detached and subsequently re-attached for saving storage and packing space.

2. Description of the Prior Art

A major concern for both the home and the workplace is containing and holding wastes, refuse, and trash until permanent disposal. Trash cans act as containers for holding trash and other wastes that are produced in any typical home or office. Trash and garbage cans often employ lids and covers to contain the trash and its associated odor, to hide the trash from view, and to prevent the trash from contaminating areas beyond the lid.

Conventional trash cans have been improved over the years to make them more user-friendly, sanitary, and hygienic. For example, many trash cans are now provided with a foot pedal positioned adjacent the base of the trash can so that a user can step on the foot pedal to open the lid of the trash can, thereby freeing up the user's hands to toss trash, or to change the plastic liner or bag that is used to line the trash can.

The conventional foot pedal usually extends from the body of the trash can. This leads to two immediate drawbacks.

First, as a result of the outwardly extending foot pedal, the containing boxes used to store the trash can must be provided in a larger size so that the foot pedal can fit within a corner of the box. Given the fact that some of these trash cans can be quite large, any small increase in the size of the containing box would significantly increase storage and transportation costs.

Second, there are some retailers who prefer to sell two or more trash cans (of different sizes) together. However, the extending foot pedals would prevent the trash cans from being nested inside each other, so that the containing box or packaging must accomodate two or more trash cans positioned side by side. This means that the packaging or box must be extremely large, thereby prohibitively increasing the storage and transportation costs.

Thus, there remains a need for a trash can assembly that overcomes the drawbacks outlined above.

SUMMARY OF THE DISCLOSURE

It is an object of the present invention to provide a trash can assembly that allows for size of the shipping box to be minimized.

It is another object of the present invention to provide a trash can assembly that allows a plurality of similar trash cans to be nested inside each other.

It is yet another object of the present invention to provide a trash can assembly that allows storage and transportation costs to be minimized.

In order to accomplish the objects of the present invention, there is provided a trash can assembly that has a shell having a bottom end, a base secured to the bottom end and a foot pedal assembly coupled to the base. The foot pedal assembly has a pedal bar pivotably secured to the base, and a foot pedal. The foot pedal can be separated from the pedal bar before placing the trash can assembly inside a containing box.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

Figure 1A:
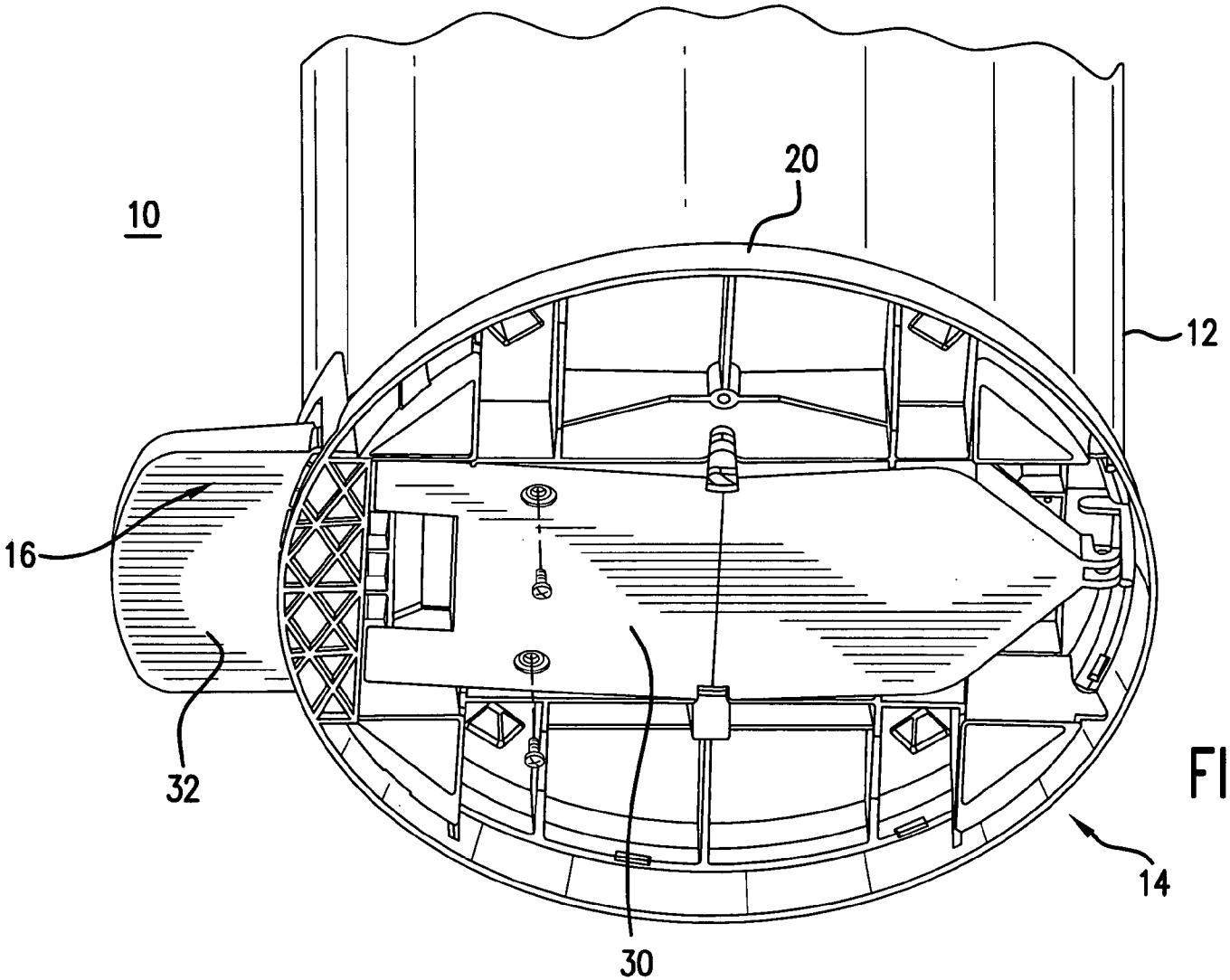
FIG. 1A is a bottom perspective view of the bottom portion of a trash can assembly according to one embodiment of the present invention.
Figure 1B:
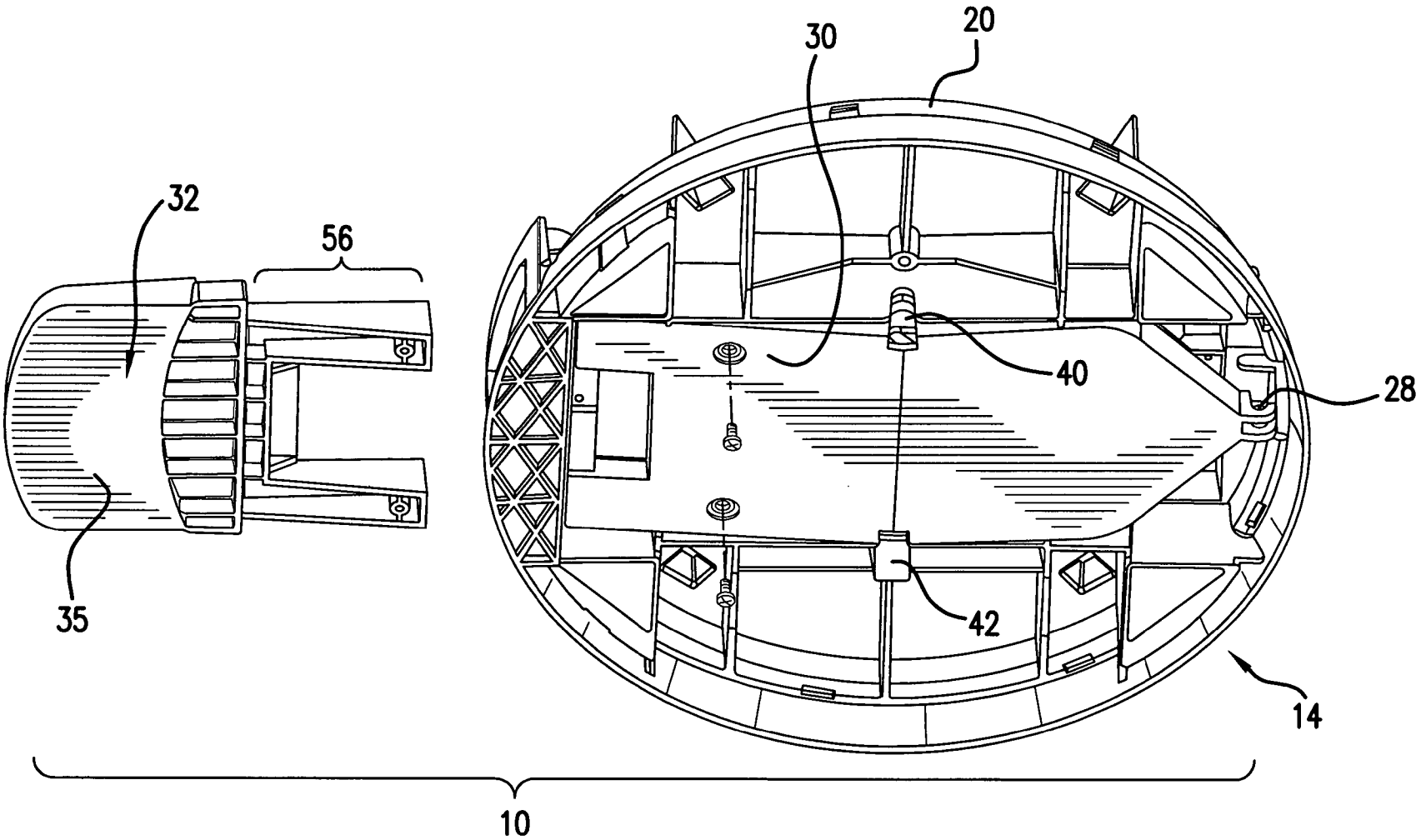
FIG. 1B is an exploded bottom perspective view of the bottom portion of the trash can assembly of FIG. 1A.
Figure 1C:
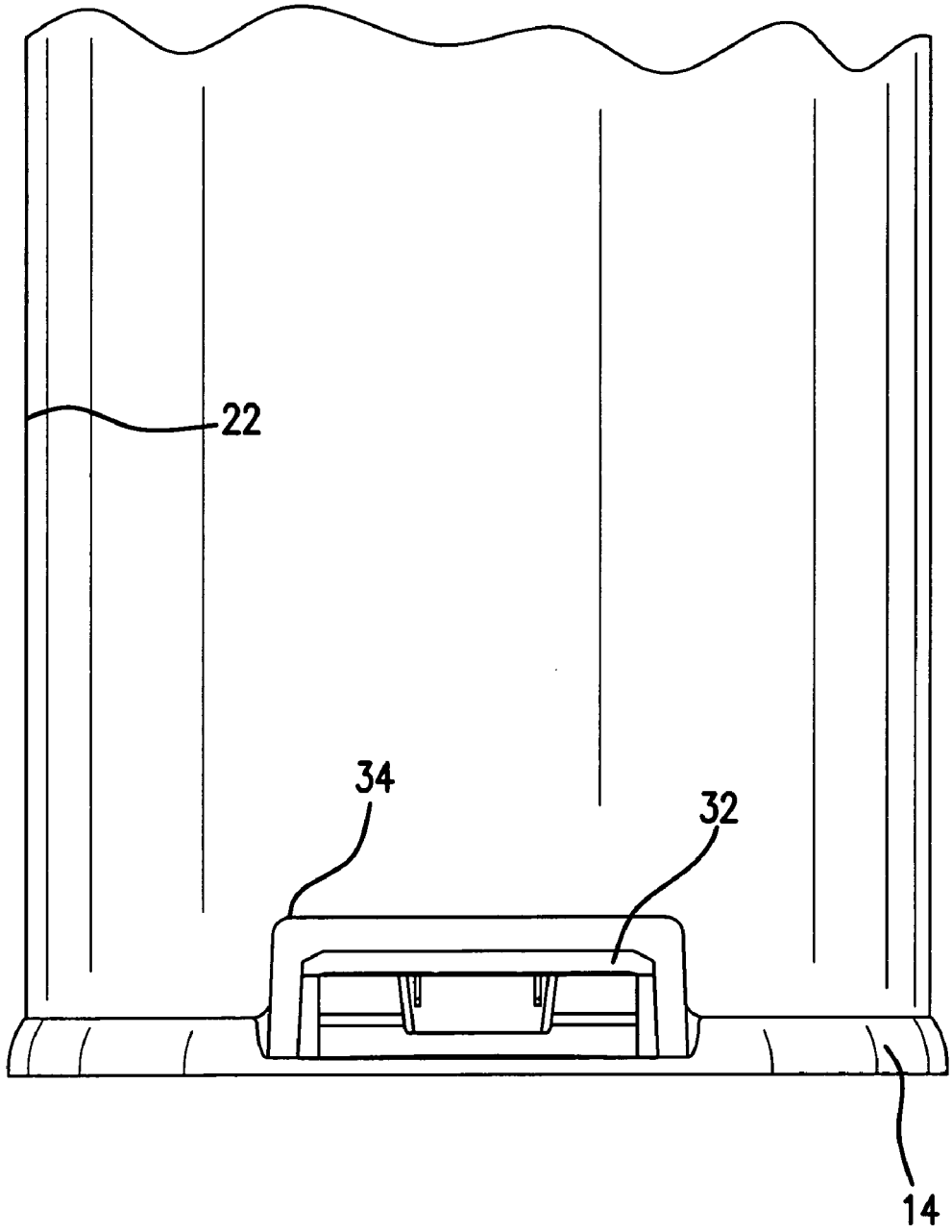
FIG. 1C is a front plan view of the trash can assembly of FIG. 1A.
Figure 2A:
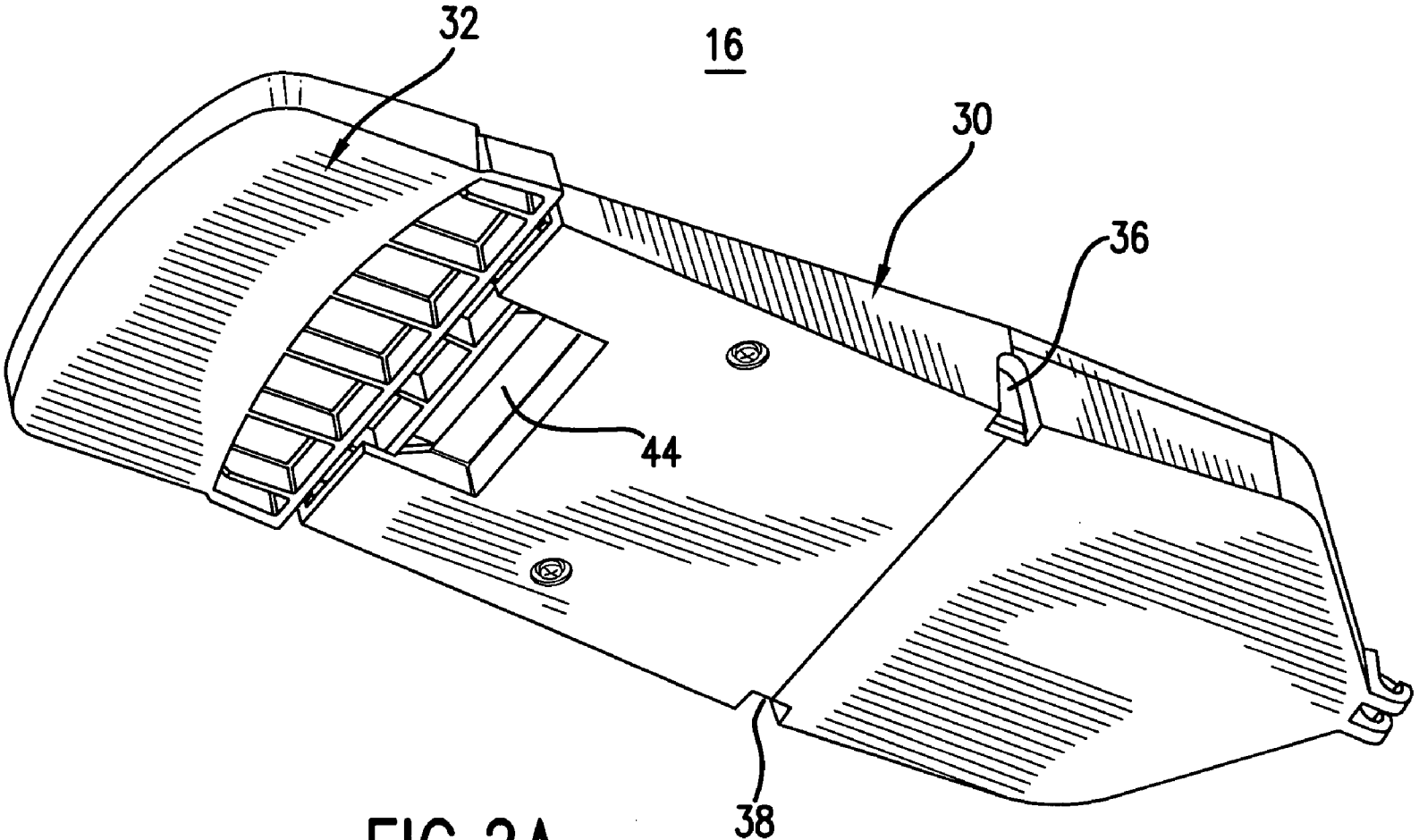
FIG. 2A is a bottom perspective view of the foot pedal assembly of the trash can assembly of FIG. 1A.
Figure 2B:
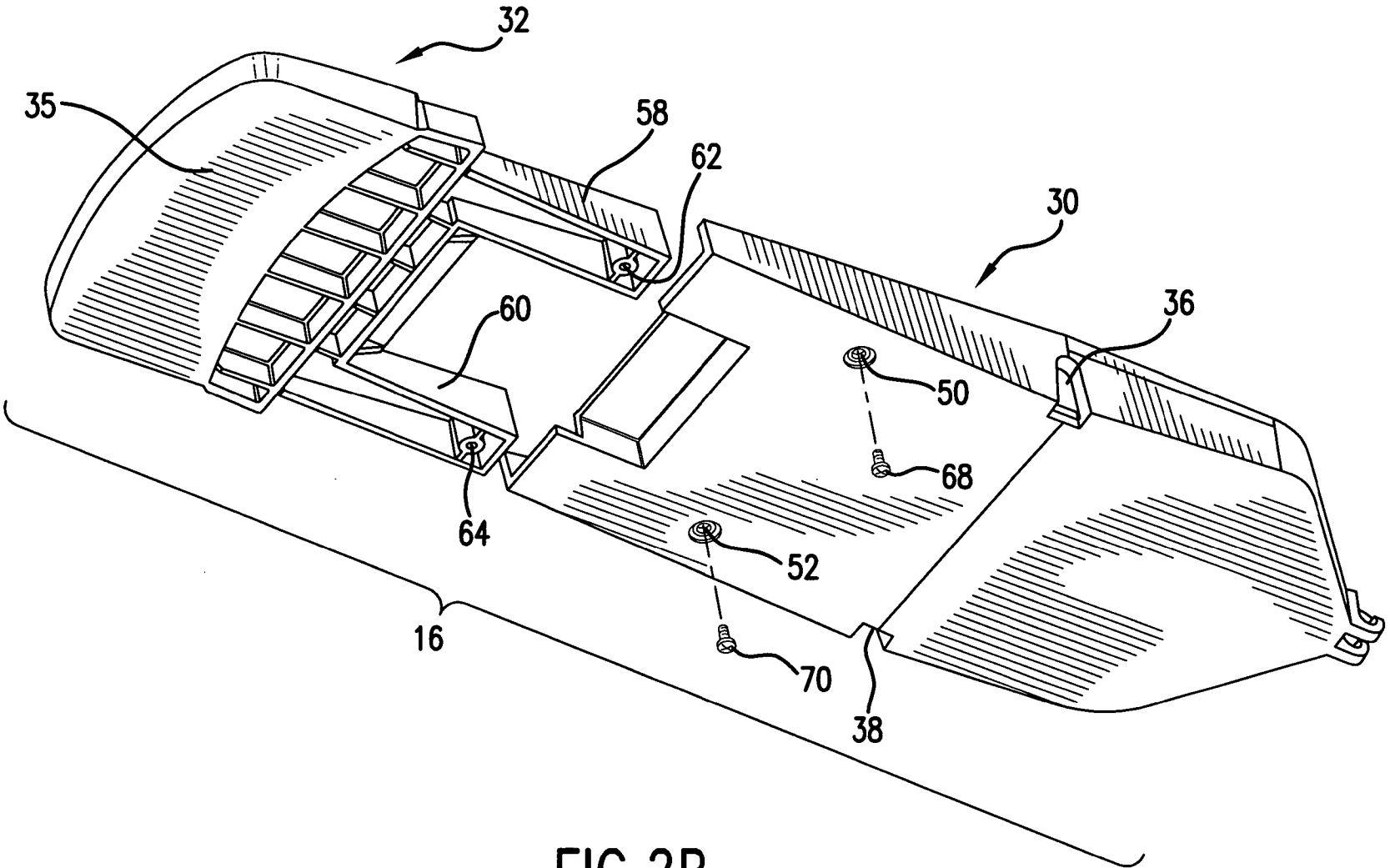
FIG. 2B is an exploded bottom perspective view of the foot pedal assembly of FIG. 2A.
Figure 3A:
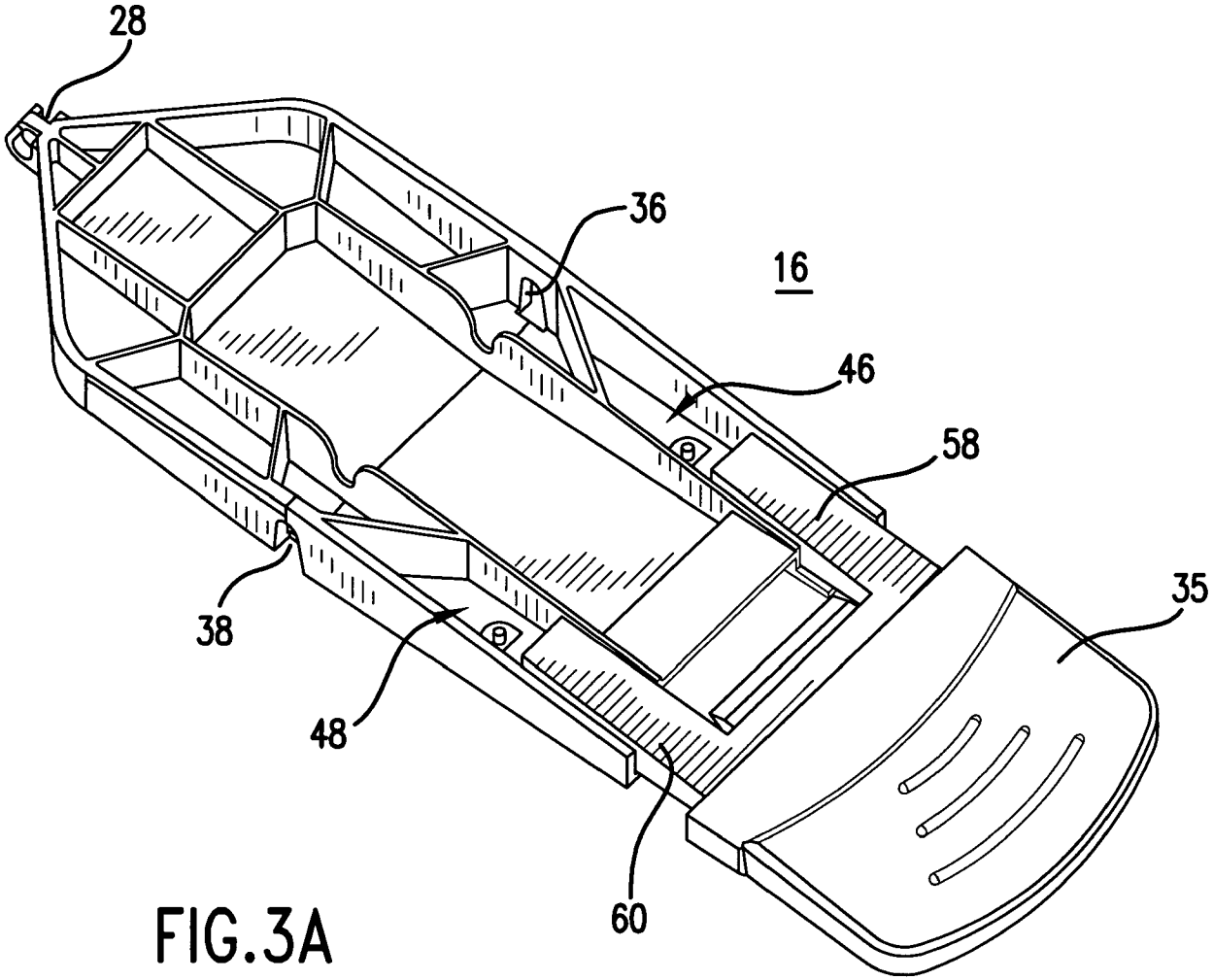
FIG. 3A is a top perspective view of the foot pedal assembly of the trash can assembly of FIG. 1A shown with the arms of the foot pedal partially inserted into the channels of the pedal bar.
Figure 3B:
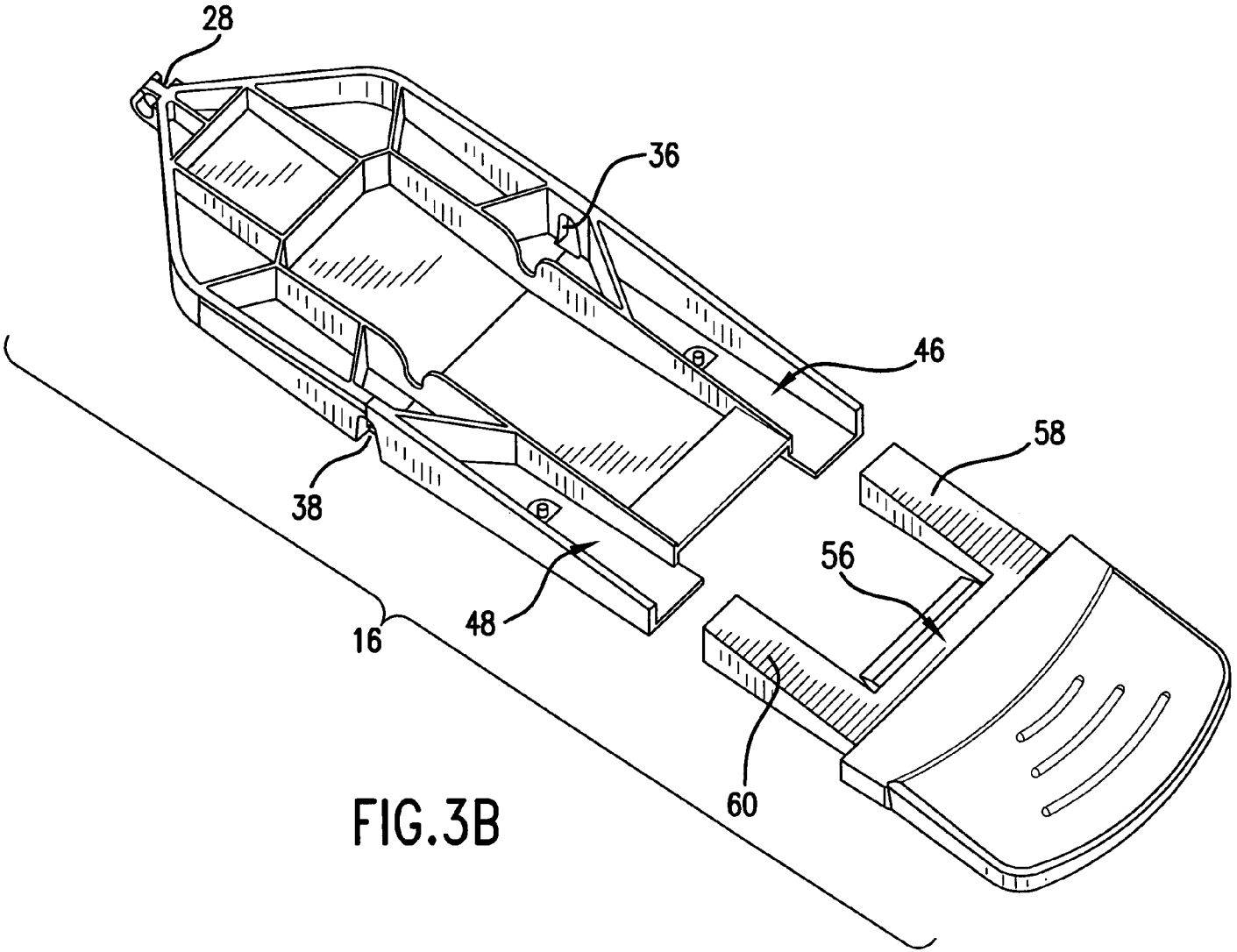
FIG. 3B is an exploded top perspective view of the foot pedal assembly of FIG. 2A.

FIGS. 1A–3B illustrate one embodiment of a trash can assembly 10 according to the present invention. Referring first to FIGS. 1A and 1B, the assembly 10 has a shell 12 and can optionally include an internal liner (not shown) that can adapted to be retained inside the shell 12. The shell 12 can be made from either plastic or metal. The liner is essentially a container, and can also be made from either plastic or metal. The shell 12 is an enclosing wall which can have any desired shape, including oval, triangular, rectangular, square or circular (among others).

A lid (not shown) is hingedly connected to the upper part of the shell 22 using hinged connections that are well-known in the art, and will not be described in greater detail herein. As one non-limiting example, the lid can be hingedly connected to the shell 12 in the manner that is described in U.S. Publication No. US-2002-0079315-A1, published on Jun. 27, 2002 and entitled "Trash Can Assembly With Toe-Kick Recess", whose entire disclosure is incorporated by this reference as though set forth fully herein. The shell 12 and its lid can be made of a solid and stable material, such as a metal. The shell 12 has a base 14, and a foot pedal assembly 16 is pivotably secured to the base 14.

A link assembly (not shown) extends from the rear (e.g., see location 28) of the foot pedal assembly 16 and then upwardly along the shell 12 to the lid. The link assembly operates to translate an up-down pivot motion of the pedal assembly 16 to an up-down pivot motion for the lid. The construction and operation of link assemblies are well-known in the art, and will not be described in greater detail herein. As one non-limiting example, the link assembly and the lid can be constructed in accordance with those which are described in U.S. Publication No. US-2002-0079315-A1, published on Jun. 27, 2002 and entitled "Trash Can Assembly With Toe-Kick Recess". The base 14 of the shell 12 defines a generally annular and curved skirt or flange portion 20. In one embodiment of the present invention, the skirt 20 is formed in one plastic piece. The shell 12 can be attached to the top of the skirt 20 of the base 14 by a groove snap-on, glue, welding, screws, and similar attachment mechanisms.

Referring now to FIGS. 1A–3B, the foot pedal assembly 16 has two separate pieces: a pedal bar 30 and a removable foot pedal 32. The pedal bar 30 is pivotably secured to the base 14, with the foot pedal 32 adapted to be inserted through an elongated opening 34 into the shell 22 (see FIG. 1C) to be attached to the pedal bar 30. A shaft (not shown) is adapted to extend through two aligned openings 36 and 38 located at about the center of the pedal bar 30, with the opposite ends of the shaft secured to retaining members 40 and 42 on the base 14. Thus, the pedal bar 30 pivots about a pivot axis defined by the shaft along the aligned openings 36, 38. The front end 44 of the pedal bar 30 has two spaced-apart longitudinal channels 46 and 48. Screw holes 50 and 52 are provided in the channels 46 and 48, respectively.

The foot pedal 32 has a U-shaped extension 56 that extends rearwardly from the pedal portion 35. The extension 56 has two spaced-apart arms 58 and 60 that are adapted to be slid into, and retained inside, the channels 46 and 48, respectively. Corresponding screw holes 62 and 64 are provided in the arms 58 and 60, respectively, and are aligned with the screw holes 50 and 52, respectively, in the channels 46 and 48, respectively.

In use, the pedal bar 30 is always pivotably secured to the base 14. When the trash can assembly 10 is being packaged for shipment and sale, the foot pedal 32 is separated from the pedal bar 30. For example, the foot pedal 32 can be stored inside the shell 12 or the liner when the trash can assembly 10 is inside a containing box. Since the foot pedal 32 does not extend from the outer periphery of the shell 12, the containing box can be provided in a smaller size since it will only need to accomodate the shell 12. In addition, a set of trash can assemblies 10 of varying sizes (all having their foot pedals 32 separated) can be nested inside the shell 12 of the larger trash can assemblies 10, thereby allowing a plurality of trash can assemblies 10 to be nested inside each other and stored in a containing box that is perhaps the same size as that needed to store just a single trash can assembly 10. Thus, the removable foot pedal 32 allows for size of the containing box to be minimized, and allows a plurality of similar trash can assemblies to be nested inside each other, thereby reducing storage and transportation costs.

When the customer purchases the trash can assembly 10, he or she removes the trash can assembly 10 from the containing box, and then attaches the foot pedal 32 to the pedal bar 30. This attachment can accomplished quickly and conveniently. In particular, the extension 56 is inserted through the opening 34 in the shell 12 until the arms 58 and 60 are entirely received inside the channels 46 and 48, respectively. A pair of screws 68 and 70 are threaded through the aligned screw holes 50+62 and 52+64, respectively, to secure the foot pedal 32 to the pedal bar 30. The foot pedal assembly 16 is now ready for use.

The foot pedal 32 can be quickly and conveniently separated from the pedal bar 30 by removing the screws 68, 70, and then pulling the extension 56 out of the opening 34.

Figure 4:
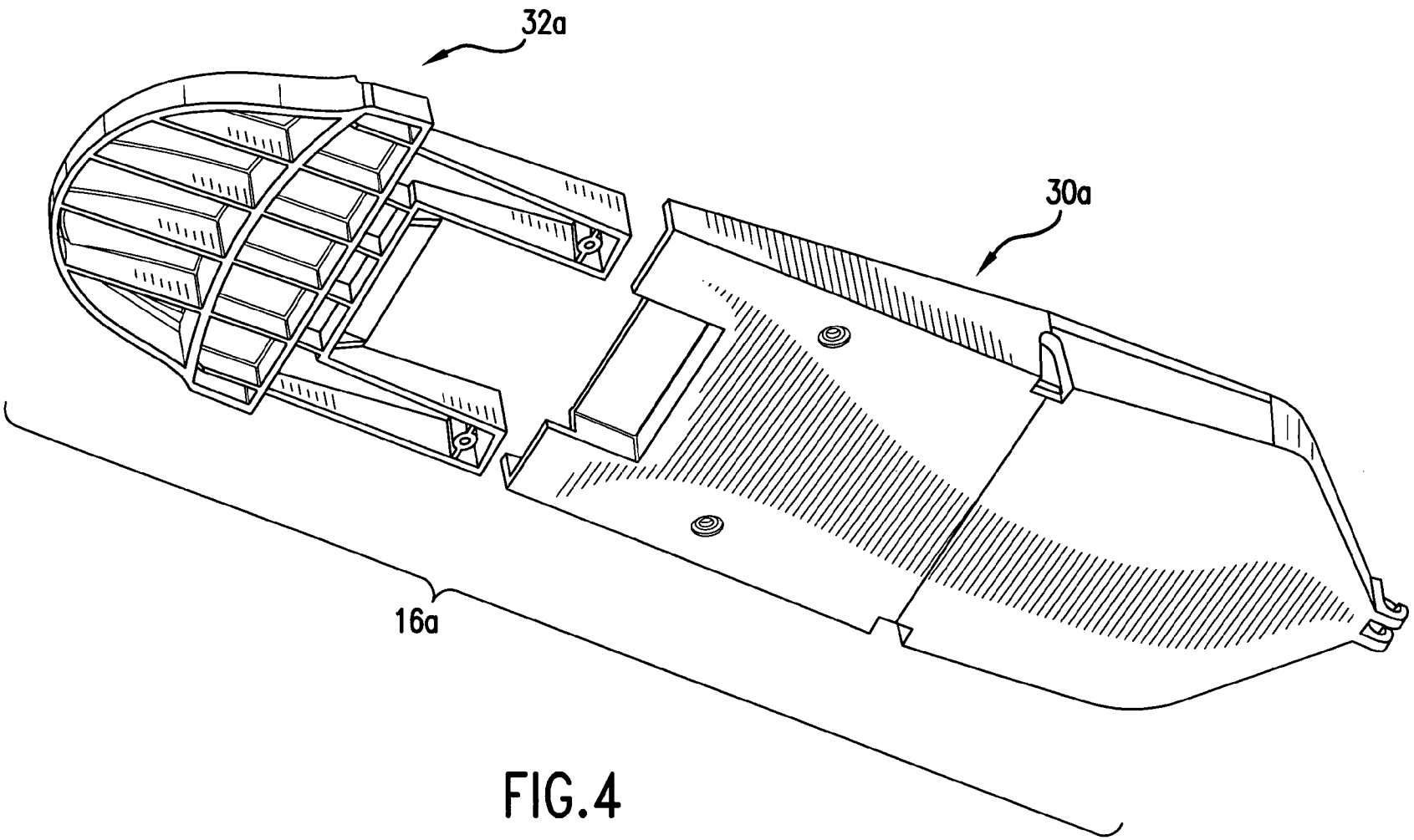
FIG. 4 is an exploded bottom perspective view of another foot pedal assembly that can be used with the trash can assembly of FIG. 1A.
Figure 5:
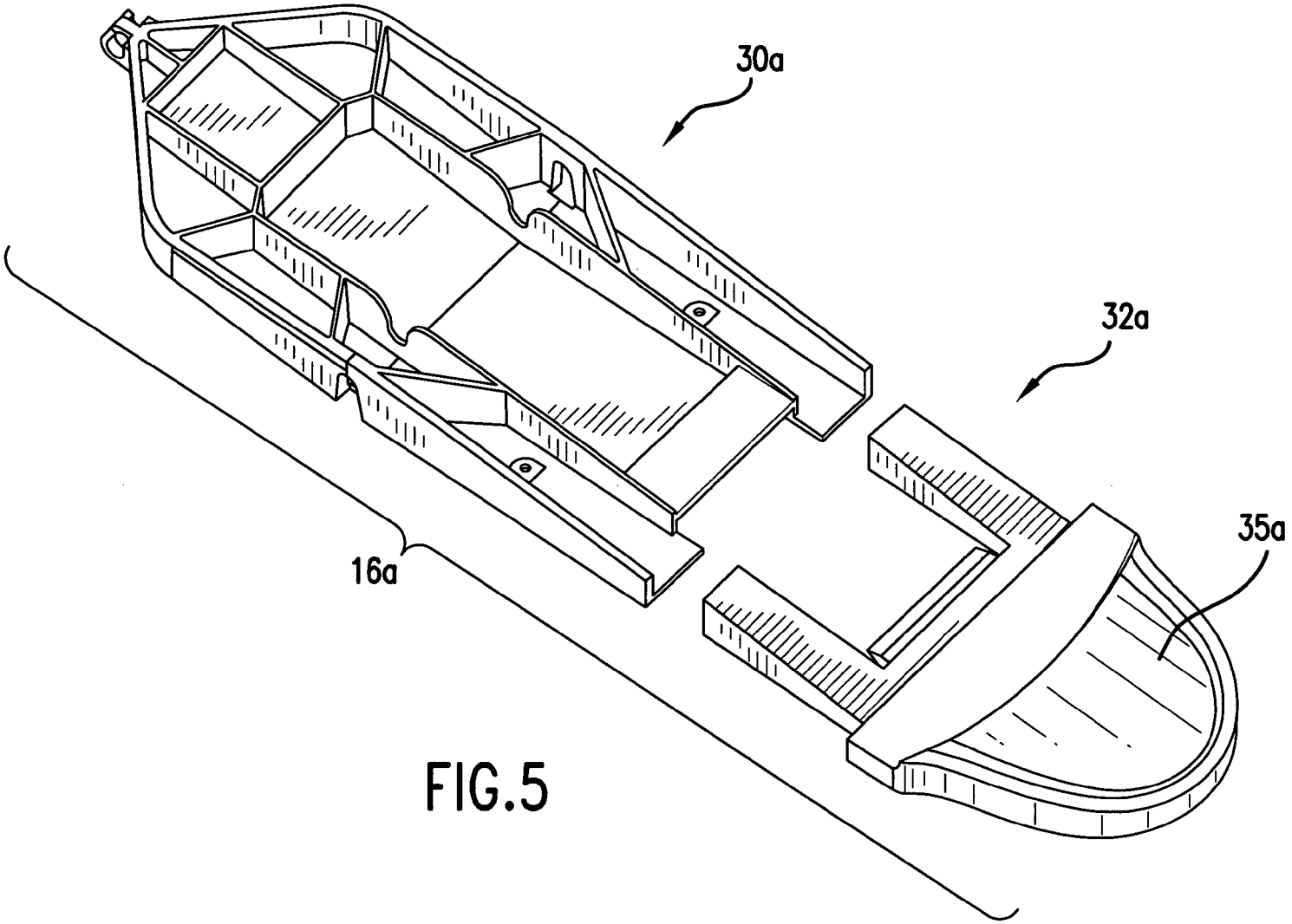
FIG. 5 is an exploded top perspective view of the foot pedal assembly of FIG. 4.

FIGS. 4 and 5 illustrate another foot pedal assembly 16*a* that can be used with the trash can assembly 10 of FIG. 1A. In FIGS. 4 and 5, the pedal bar 30*a* can be identical to the pedal bar 30 illustrated in FIGS. 1A–3B, and the foot pedal 32*a* can be the same as the foot pedal 32 except that the pedal portion 35*a* has a different shape from the pedal portion 35. FIGS. 4 and 5 are provided to illustrate that different foot pedals 32, 32*a* can be removably attached to the same pedal bar 30, 30*a*, and this allows the customer to select the desired foot pedal 32, 32*a* from a variety of different foot pedals that might be provided by the manufacturer.

The above detailed description is for the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices, components, mechanisms and methods are omitted so as to not obscure the description of the present invention with unnecessary detail.

What is claimed is:

1. A trash can assembly, comprising:

a shell having a bottom end the shell defining an outer periphery that encloses an interior space;

a foot pedal assembly comprising:

a pedal bar pivotably secured to the bottom end and positioned entirely within the outer periphery of the shell; and a foot pedal that is provided separately from the pedal bar, and which is removably connected to the pedal bar.

2. The assembly of claim 1, wherein the pedal bar includes:

a front end; and a channel provided in the front end.

3. The assembly of claim 2, wherein the foot pedal includes:

a pedal portion; and an arm extending rearwardly from the pedal portion and being received inside the channel.

4. The assembly of claim 3, further including means for removably securing the arm in a fixed location inside the channel.

5. The assembly of claim 3, wherein the channel comprises two spaced-apart channels, and the arm comprises two spaced apart arms.

6. The assembly of claim 1, wherein the pedal bar pivots about the base at a location that is at about the center of the pedal bar.

7. A foot pedal assembly for use in a trash can assembly, comprising:

a pedal bar pivotably secured to a bottom part of the trash can assembly, the pedal bar having a front end and a channel provided in the front end; and a foot pedal that is provided separately from the pedal bar, and which is removably connected to the pedal bar, the foot pedal having a pedal portion an arm extending rearwardly from the pedal portion and being received inside the channel.

8. The assembly of claim 7, further including means for removably securing the arm in a fixed location inside the channel.

9. The assembly of claim 7, wherein the channel comprises two spaced-apart channels, and the arm comprises two spaced apart arms.

10. A method of storing a trash can assembly inside a box, comprising:

providing a trash can assembly that has foot pedal assembly, the foot pedal assembly having a pedal bar pivotably secured to a base of the trash can assembly, and a foot pedal;

separating the foot pedal from the pedal bar;

placing the separated foot pedal and pedal bar inside the box.

11. The method of claim 10, further including:

storing the foot pedal inside the shell.

12. The assembly of claim 1, wherein a portion of the foot pedal extends into the enclosed interior space.

13. The assembly of claim 1, wherein the pedal bar is a single pedal bar.

14. A trash can assembly, comprising:

a shell having a bottom end, the shell defining an outer periphery that encloses an interior space;

a foot pedal assembly comprising:

a pedal bar pivotably secured to the bottom end; and a foot pedal that is provided separately from the pedal bar, and which is removably connected to the pedal bar, wherein a portion of the foot pedal extends into the enclosed interior space.

15. The assembly of claim 14, wherein the pedal bar is a single pedal bar.

* * * * *